US007150649B2

(12) United States Patent
Van Der Mee et al.

(10) Patent No.: US 7,150,649 B2
(45) Date of Patent: Dec. 19, 2006

(54) MULTICONTACT CONNECTOR INSERT AND A MULTICONTACT CONNECTOR FITTED WITH SUCH AN INSERT

(75) Inventors: Marnix Van Der Mee, Montlouis sur Loire (FR); Armel Baldyrou, Monthodon (FR); Thomas Pichot, Le Mans (FR)

(73) Assignee: Radiall, Rosny-sous-bois (FR)

( * ) Notice: Subject to any disclaimer, the term of this patent is extended or adjusted under 35 U.S.C. 154(b) by 0 days.

(21) Appl. No.: 11/332,226

(22) Filed: Jan. 17, 2006

(65) Prior Publication Data

US 2006/0160391 A1 Jul. 20, 2006

(30) Foreign Application Priority Data

Jan. 18, 2005 (FR) ..... 05 50139

(51) Int. Cl.
*H01R 13/40* (2006.01)

(52) U.S. Cl. ..... 439/589

(58) Field of Classification Search ..... 439/587–589, 439/586, 272, 273, 274, 275, 278, 279, 283
See application file for complete search history.

(56) References Cited

U.S. PATENT DOCUMENTS 4,214,802 A * 7/1980 Otani et al. ..... 439/275
4,544,224 A 10/1985 Goodman et al.
4,629,269 A 12/1986 Kailus
5,564,947 A 10/1996 Ingles et al.
5,762,524 A * 6/1998 Ford et al. ..... 439/589

FOREIGN PATENT DOCUMENTS

| | | |
|---|---|---|
| EP | 0 903 814 A1 | 3/1999 |
| FR | 2 572 857 A1 | 5/1986 |
| FR | 2 742 264 A1 | 6/1997 |

* cited by examiner

*Primary Examiner*—Ross Gushi
(74) *Attorney, Agent, or Firm*—Oliff & Berridge, PLC

(57) ABSTRACT

A multicontact connector insert may be configured to be placed in a housing of a connector casing. The housing may be formed at least in part by a tubular wall. The insert may include:

a front face and a rear face;

a side wall extending between the front and rear faces;

at least one cavity extending between the front and rear faces and configured to receive at least one contact element; and at least two sealing lips, extending over the side wall and configured to bear against the tubular wall of the connector casing when the insert is placed in the housing.

21 Claims, 2 Drawing Sheets

MULTICONTACT CONNECTOR INSERT AND A MULTICONTACT CONNECTOR FITTED WITH SUCH AN INSERT

The present invention relates to a multicontact connector insert and to a multicontact connector fitted with such an insert.

BACKGROUND

By way of example, presently-known multicontact connectors include those of the EPX A and B ranges sold by the supplier Radiall, and comprising:

- a connector casing having at least one housing formed at least in part by a tubular wall of the casing; and
- an insert arranged to be placed in said housing and comprising:
  - a front face and a rear face;
  - a side wall extending between the front and rear faces; and
  - at least one cavity extending between the front and rear faces and arranged to receive at least one contact element, in particular a male or a female electrical contact element.

In a connector of this type, there exists in particular a need to improve the sealing between the insert and the tubular wall of the housing.

SUMMARY

The invention thus provides a multicontact connector insert arranged to be placed in a housing of a connector casing, the housing being formed at least in part by a tubular wall, and the insert comprising:

- a front face and a rear face;
- a side wall extending between the front and rear faces; and
- at least one cavity extending between the front and rear faces and arranged to receive at least one contact element; the insert including at least one preferably annular sealing lip, extending over said side wall and suitable for coming to bear against the tubular wall of the connector casing when the insert is placed in said housing.

The invention enables satisfactory sealing to be obtained between the insert and the tubular wall of the housing that receives the insert.

Preferably, the sealing lip(s) is/are compressible so as to press against the tubular wall of the housing with force that is sufficient to provide the desired degree of sealing, in particular against a gas or a fluid under pressure.

In an embodiment of the invention, the sealing lip(s) is/are made of elastomer, in particular of rubber. In a variant, the sealing lip(s) may be made of any other suitable compressible material.

In an embodiment of the invention, the sealing lip(s) include an annular rim presenting a shape that converges substantially towards the front face of the insert. This shape serves in particular to facilitate introduction and guidance of the insert in the housing.

The sealing lip(s) may include a rear annular rim presenting a shape that converges substantially towards the rear face of the insert or that is substantially perpendicular to the side wall of the insert. The shape of the rear annular rim may be selected to facilitate introducing an extractor tool, where necessary, in order to be able to extract the insert from the housing.

Advantageously, the front annular rim of the sealing lip extends over a height measured in a direction parallel to the side wall of the insert that is greater than that of the rear annular rim, and in particular that is at least twice as large.

In an embodiment of the invention, the insert includes at least two sealing lips, e.g. two or three sealing lips, preferably disposed in substantially adjacent manner.

The insert may include a rear portion defining the rear face of the insert and made in particular of elastomer, e.g. of rubber, and the sealing lip(s) may be made integrally with said rear portion.

This rear portion may be assembled with a central portion of the insert, the central portion presenting greater rigidity than the rear portion.

In a variant, the sealing lip(s) is/are made separately and/or of a material that is different from that of the rear portion, e.g. being made by being co-molded with the rear portion.

In an embodiment of the invention, the central portion includes at least one outside shoulder.

The insert may include a front portion defining the front face of the insert, said front portion preferably being made of elastomer, and in particular being assembled with a central portion of the insert.

In a cross-section parallel to the front and rear faces, the insert may present a shape that is substantially rectangular or circular.

The invention also provides a multicontact connector, comprising:

- a connector casing having at least one housing formed at least in part by a tubular wall; and
- an insert as defined above, placed in said housing of the casing.

Advantageously, the sealing lip(s) of the insert bare(s) against the tubular wall of the housing of the casing by being compressed over at least part and preferably over the entire periphery of the insert when the lips are annular.

The above-mentioned compression of the sealing lip may be obtained in particular by the fact that its dimensions are slightly greater than the corresponding dimensions of the tubular wall of the housing.

The connector may include at least one male or female electrical contact element, and/or at least one optical contact element introduced into a cavity of the insert.

In an embodiment of the invention, the insert is arranged to be capable of being mounted in the housing of the casing in removable manner. In a variant, mounting is not reversible.

The connector may include at least one elastically deformable tab arranged to press against an outside shoulder of the insert when the insert is in place in the housing of the casing.

The insert can thus be put into place in the housing and can thus be held therein in a manner that is relatively simple.

The invention also provides a method of assembling a connector of the kind described above, the method including the following step:

- introducing the insert into the housing of the casing.

The invention also provides a method of extracting an insert from a housing of a casing in a connector as described above, the method including the following step:

- using an extractor tool in particular for acting on one or more elastically deformable tabs of the connector, the extractor tool being inserted at least in part between the sealing lip(s) of the insert and the tubular wall of the housing.

BRIEF DESCRIPTION OF THE DRAWINGS

The invention can be better understood on reading the following detailed description of a non-limiting embodiment of the invention, and on examining the accompanying drawings, in which.

MORE DETAILED DESCRIPTION

Figure 1:
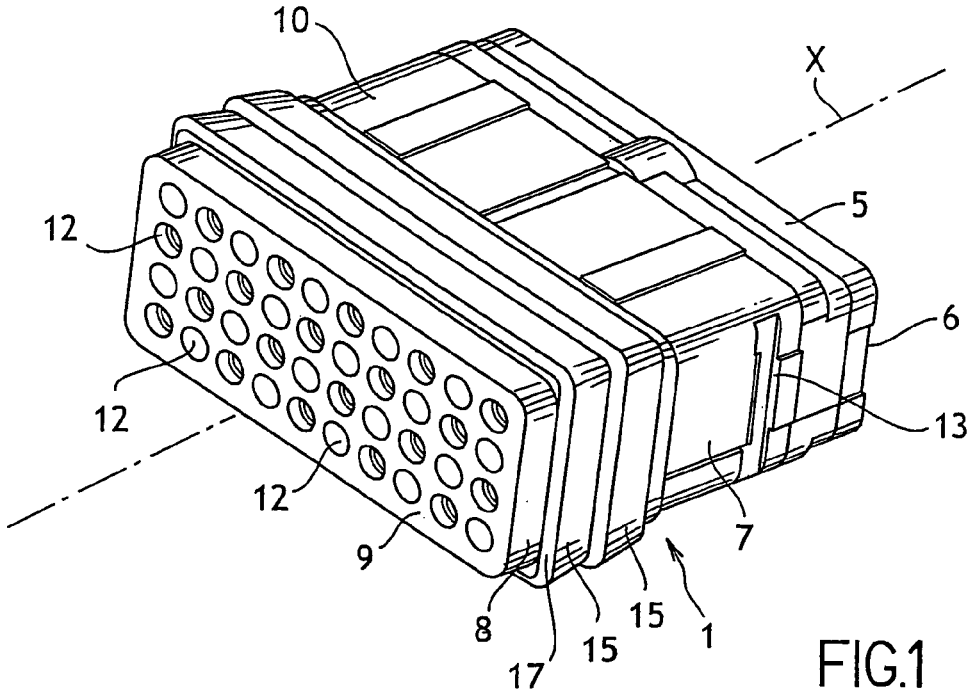
FIGS. 1 and 2 are diagrammatic and fragmentary views in perspective seen from two different viewpoints showing a connector insert in accordance with the invention.
Figure 2:
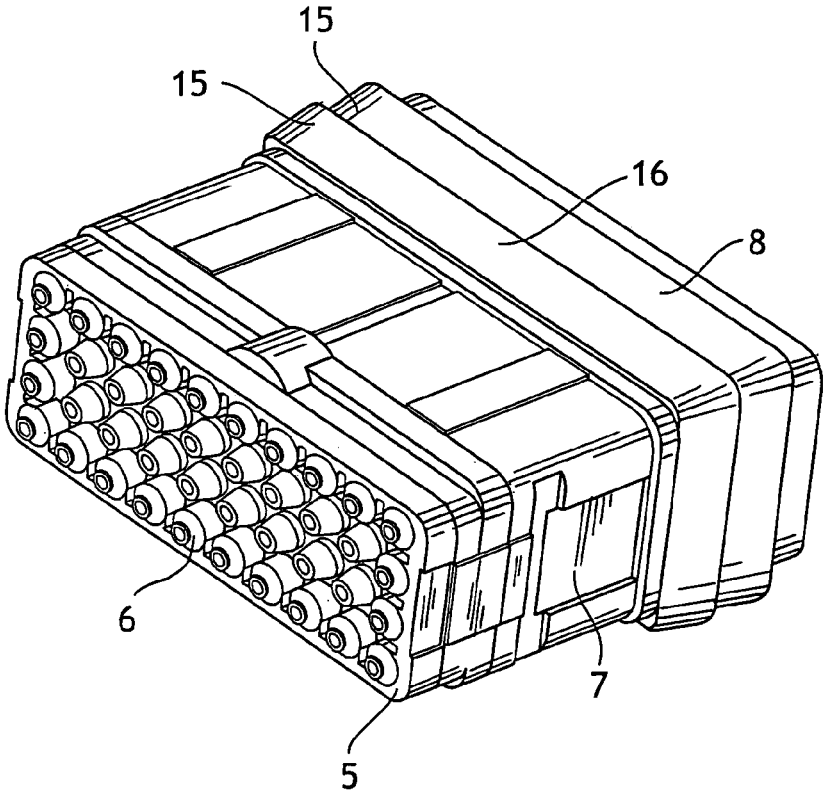

FIGS. 1 and 2 show a connector insert 1 in accordance with the invention, suitable for being placed in a housing 2 of a connector casing 3.

The insert 1 comprises a front portion 5 defining a front face 6, a central portion 7, and a rear portion 8 defining a rear face 9.

The front and rear faces 6 and 9 extend substantially parallel to an axis X.

The insert 1 presents a side wall 10 between the front and rear faces 6 and 9, the side wall 10 extending substantially parallel to the axis X.

In the example described, the front and rear portions 5 and 8 are made of elastomer, e.g. of rubber.

The central portion 7 is made of a plastics material, for example.

The insert 1 includes a plurality of cavities 12 which may be identical or which may comprise at least two different types.

The cavities 12 extend from the front face 6 to the rear face 9 of the insert 1 and they are arranged to receive male or female electrical contact elements and/or optical contact elements (not shown).

In the example described, in a cross-section perpendicular to the axis X, the insert 1 presents a shape that is substantially rectangular.

In a variant, the insert 1 may be of the cylindrical type and present a cross-section that is circular.

The central portion 7 has two shoulders 13 each extending over a short side of the rectangle of the insert, each shoulder 13 being substantially perpendicular to the axis X.

The rear portion 8 has two annular sealing lips 15 that are adjacent, projecting over the entire periphery of the side wall 10 of the insert 1.

Each sealing lip 15 includes a front annular rim 16 turned towards the front face 6 of the insert 1, said annular rim 16 having a shape that converges substantially towards the front face 6.

Figure 3:
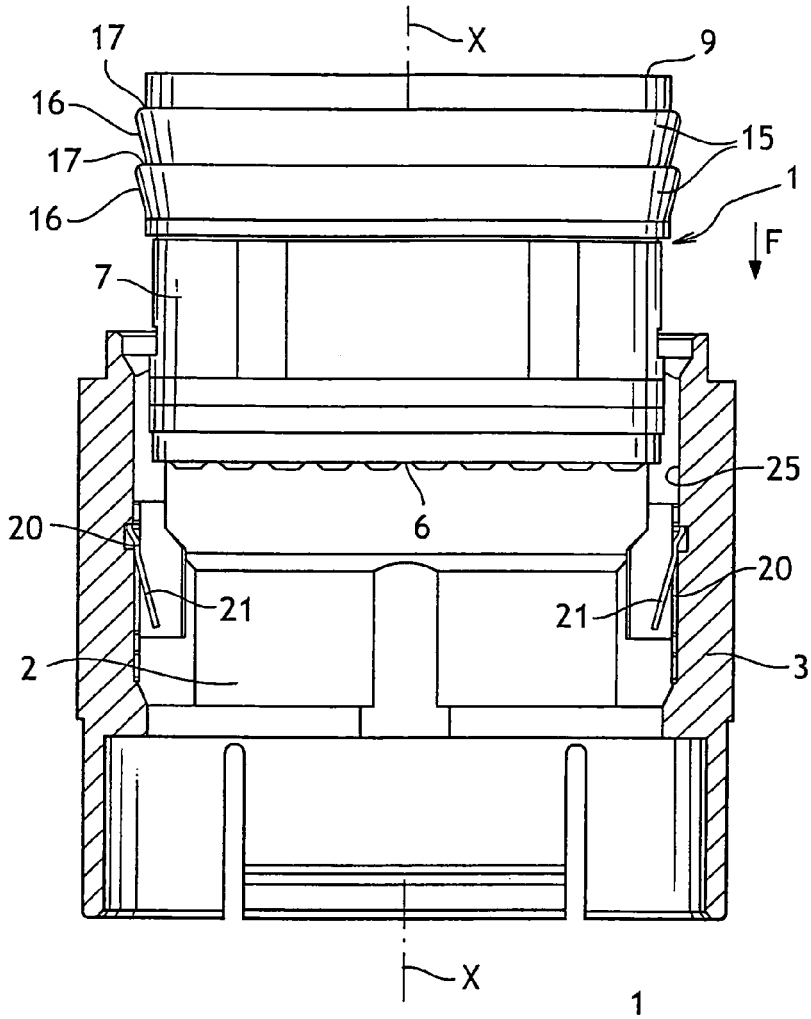
FIGS. 3 and 4 are diagrammatic and fragmentary views showing two steps in assembling the insert of FIGS. 1 and 2 in a housing of a connector casing.

Each annular lip 15 further includes a rear annular rim 17 of a shape that converges slightly towards the rear face 9, as shown in FIG. 3 in particular.

In a variant, the rear annular rim 17 may extend substantially perpendicularly to the axis X.

In the example described, the front annular rim 16 presents a height measured along the axis X that is greater than the height of the rear annular rim 17.

In a variant, the front and rear annular rims 16 and 17 could present heights that are substantially identical, where appropriate.

The sealing lips 15 are made integrally with the rear portion 8.

In the example described, the housing 2 defined by a tubular wall 25 presents a shape in cross-section perpendicular to the axis X that is substantially rectangular.

In a variant, when the connector is of the cylindrical type, the cross-section of the housing receiving the insert is substantially circular.

The connector casing 3 is made of metal, for example.

In a variant (not shown), the casing 3 may include a plurality of housings 2 each receiving one insert.

Figure 4:
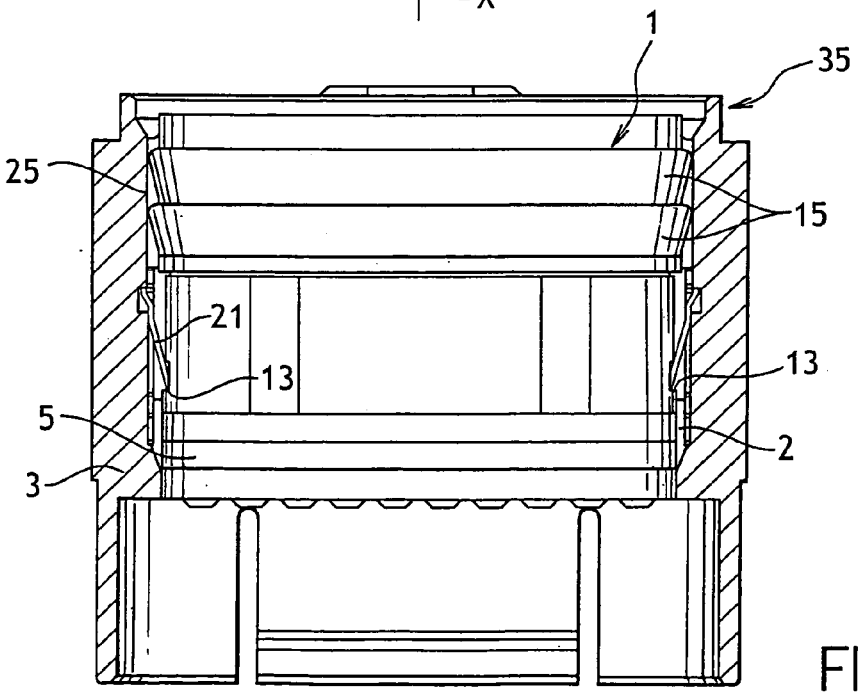

The housing 2 in the connector casing 3 receives retention elements 20, e.g. comprising one or more elastically deformable tabs 21 arranged to hold the insert 1 in the housing 2, as shown in FIGS. 3 and 4.

The insert 1 is mounted in the housing 2 of the connector casing 3 by introducing the insert 1 via its front face 6 into the housing 2 in a direction parallel to the axis X and represented by arrow F as shown in FIG. 3.

At the end of the stroke, the elastically deformable tabs 21 of the retention elements 20 press against shoulders 13 of the insert 1, as shown in FIG. 4.

It is thus relatively simple to mount the insert 1 in the housing 2 by snap-fastening.

The sealing lips 15 then bear against the tubular wall 25 of the housing 2, since they are compressed.

The assembly formed by the insert 1 and the casing 3 defines a multicontact connector 35 presenting improved sealing in the housing 2.

Figure 5:
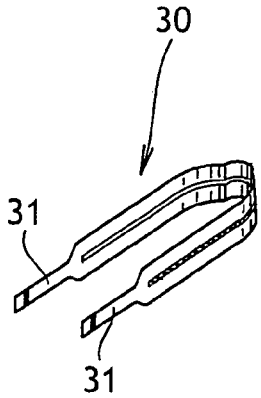
FIG. 5 is a diagrammatic and fragmentary perspective view of an extractor tool.

It is possible to extract the insert 1 from the housing 2 with the help of an extractor tool 30 shown diagrammatically in FIG. 5, which tool is substantially U-shaped.

The extractor tool 30 comprises two limbs 31 suitable for being inserted between the sealing lips 15 and the tubular wall 25 of the casing 3 in order to reach the elastically deformable tabs 21 and press them down against the tubular wall 25 so as to enable the insert 1 to be extracted from the housing 2.

The shape of the rear annular rim 17 of each sealing lip 15 is advantageously selected in such a manner as to facilitate inserting the limbs 31 of the extractor tool 30.

Preferably, inserting the extractor tool 30 does not excessively damage the sealing lips 15.

Naturally, the invention is not limited to the embodiment described above.

In particular, the insert 1 may have some number of sealing lips 15 other than two, for example a single sealing lip, or three sealing lips.

The sealing lips 15 may be identical or otherwise.

For example, the two sealing lips 15 may be symmetrical to each other above a plane perpendicular to the axis X, first and second lips having respective front annular rims that are respectively taller and shorter than their rear annular rims.

The two sealing lips 15 may be adjacent, or in a variant they may be spaced apart a certain distance along the side wall 10.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A multicontact connector having an insert configured to be placed in a housing of a connector casing, the housing being formed at least in part by a tubular wall, and the insert comprising:

a front face and a rear face;

a side wall extending between the front and rear faces;

at least one cavity extending between the front and rear faces and configured to receive at least one contact element;

a rear portion defining the rear face;

at least two sealing lips disposed in an adjacent manner, extending over said side wall and configured to bear against the tubular wall of the connector casing when the insert is placed in said housing, said lips being integral with the rear portion of the insert; and at least one elastically deformable tab configured to bear against an outside shoulder of the insert when the insert is in the housing in the casing.

2. A multicontact connector according to claim 1, wherein the sealing lips comprise a front annular rim of a shape that converges substantially toward the front face of the insert.

3. A multicontact connector according to claim 1, wherein the sealing lips comprise a rear annular rim of a shape that at least one of converges substantially toward the rear face of the insert and is substantially perpendicular to the side wall of the insert.

4. A multicontact connector according to claim 1, wherein the front rim extends over a height, measured in a direction parallel to the side wall of the insert, that is greater than the height of the rear rim, and wherein the sealing lips comprise a rear annular rim of a shape that at least one of converges substantially toward the rear face of the insert and is substantially perpendicular to the side wall of the insert.

5. A multicontact connector according to claim 1, comprising at least three sealing lips.

6. A multicontact connector according to claim 1, further comprising a front portion defining the front face of the insert, said front portion comprising elastomer, said front portion being assembled to a central portion of the insert.

7. A multicontact connector according to claim 1, comprising a substantially rectangular shape in cross-section parallel to the front and rear faces.

8. A multicontact connector according to claim 1, wherein each sealing lip of the insert bears against the tubular wall of the housing in the casing by being compressed at least in part.

9. A multicontact connector according to claim 1, further comprising at least one of an electrical contact element and an optical contact element inserted in a cavity of the insert.

10. A multicontact connector according to claim 1, wherein the insert is configured to be capable of being mounted in the housing of the casing in a removable manner.

11. A method of assembling a multicontact connector as defined in claim 1, the method comprising:

introducing the insert into the housing of the casing.

12. A method of extracting an insert from a housing in a casing of a multicontact connector according to claim 1, the method comprising:

using an extractor tool by inserting the extractor tool at least in part between the sealing lips of the insert and the tubular wall of the housing.

13. A multicontact connector according to claim 1, wherein said sealing lips are annular.

14. A multicontact connector according to claim 2, the rear portion defining the rear face of the insert comprising elastomer.

15. A multicontact connector according to claim 1, wherein the sealing lips are compressible.

16. A multicontact connector according to claim 15, wherein the sealing lips comprise elastomer.

17. A multicontact connector according to claim 16, wherein said elastomer comprises rubber.

18. A multicontact connector according to claim 1, wherein said rear portion is assembled to a central portion of the insert, said central portion including a rigidity that is greater than a rigidity of the rear portion.

19. A multicontact connector according to claim 18, wherein the central portion comprises at least one outside shoulder.

20. A multicontact connector according to claim 1, wherein each of the sealing lips includes a front annular rim of a shape that converges substantially toward the front face of the insert, and a rear annular rim of a shape that at least one of converges substantially toward the rear face of the insert and is substantially perpendicular to the side wall of the insert, said front rim extending over a height measured in a direction parallel to the side wall of the insert that is greater than a height of the rear rim.

21. A multicontact connector according to claim 1, wherein the at least one sealing lip includes a front annular rim of a shape that converges substantially toward the front face of the insert, and a rear annular rim of a shape that at least one of converges substantially toward the rear face of the insert and is substantially perpendicular to the side wall of the insert, said front rim extending over a height measured in a direction parallel to the side wall of the insert that is greater than a height of the rear rim.

* * * * *